US006220400B1

(12) United States Patent
Kickbush

(10) Patent No.: US 6,220,400 B1
(45) Date of Patent: Apr. 24, 2001

(54) RAILWAY CAR RETARDER

(75) Inventor: Greg F. Kickbush, Port Washington, WI (US)

(73) Assignee: Trackside Services, Inc., Milwaukee, WI (US)

( * ) Notice: Subject to any disclaimer, the term of this patent is extended or adjusted under 35 U.S.C. 154(b) by 0 days.

(21) Appl. No.: 09/187,647

(22) Filed: Nov. 6, 1998

(51) Int. Cl.[7] ..... B61K 7/02

(52) U.S. Cl. ..... 188/62; 188/43; 246/182 A; 184/26.2

(58) Field of Search ..... 188/35, 41, 43, 188/62; 74/99 R, 105, 469; 246/182 A, 182 BH; 104/26.2

(56) References Cited

U.S. PATENT DOCUMENTS

| | | | | |
|---|---|---|---|---|
| Re. 36,084 | * | 2/1999 | Gutknecht | 104/249 |
| 2,326,924 | * | 8/1943 | Bowe . | |
| 3,196,985 | * | 7/1965 | Rowe . | |
| 3,659,680 | * | 5/1972 | Soulakis | 188/62 |
| 3,946,973 | | 3/1976 | Budway et al. . | |
| 4,030,574 | | 6/1977 | Evans . | |
| 4,125,177 | | 11/1978 | Durraffourt . | |
| 4,198,909 | | 4/1980 | Plantureux . | |
| 4,513,843 | | 4/1985 | Danieli . | |
| 4,535,872 | | 8/1985 | Bick et al. . | |
| 4,650,038 | | 3/1987 | Bick . | |
| 4,867,279 | | 9/1989 | Link et al. . | |
| 5,092,248 | | 3/1992 | Parry . | |
| 5,333,707 | | 8/1994 | Kaneda . | |
| 5,388,525 | | 2/1995 | Bodkin . | |
| 5,575,218 | | 11/1996 | Gutknecht . | |
| 5,676,337 | | 10/1997 | Giras et al. . | |

* cited by examiner

*Primary Examiner*—Christopher P. Schwartz
*Assistant Examiner*—C. J. Bartz
(74) *Attorney, Agent, or Firm*—Reinhart, Boerner, Van Deuren, Norris & Rieselbach, s.c.

(57) ABSTRACT

A low-profile railway car retarder system comprising a fulcrum pin, an upper and a lower lever, and two braking assemblies, is disclosed. The levers are located beneath a horizontal plan drawn from the top of the rail, thereby preventing inadvertent contact with a passing car. The braking actuator comprises an air-tight bladder which is filled with fluid or drained of fluid to cause the frictional braking members to move between closed and opened braking positions, and provides greater control than prior art systems.

11 Claims, 2 Drawing Sheets

RAILWAY CAR RETARDER

This invention relates to railway braking systems, and more particularly, to a low-profile pneumatically operated braking actuator for a hump-type railway car retarder system.

In railway classification yards, cars are separated from engines and sorted or classified based both on the type of car and the contents of the cars. In humptype classification yards, a series of side tracks are positioned on a sloped surface, leading downhill from the main track. Often, the tracks are also curved. As cars are separated from a train, each car is directed to a specific side track based on the type and content of the car, and is allowed to roll down the sloped surface. A railway car retarding system, generally comprising a frictional braking system having frictional braking members which engage and grip the sides of the passing wheels of the railway cars, is employed to slow and stop the cars on the sloped or curved side tracks.

In recent years, the design of railway cars has been modified in order to increase the load-carrying capacity of the cars. Increasingly, railway cars are being designed lower to the ground, such that the distance between the bed of the railway cars and the rails below is decreased.

Existing braking systems generally include pneumatic or hydraulic piston cylinder actuators which activate the frictional braking members. Generally, the frictional braking members are coupled to a support tube or other device which extends above and in close proximity to the adjacent rail. As the piston cylinder is activated, the motion of the support tube forces the frictional braking member towards the passing car.

The piston cylinder actuators of existing systems are typically controlled by a computerized control system, which activates the actuators, and determines the level of pressure to apply to a given car based on a number of factors such as rail grade, car type, car weight, and wind resistance.

To provide an effective retardation of the cars it is important that the frictional braking members be applied to the cars in a controlled and repeatable fashion. Pneumatic or hydraulic piston cylinder actuators, however, are problematic in this regard for several reasons. First, as noted above, in traditional hydraulic or pneumatic cylinder actuators, the frictional braking elements of the retarding system are pivoted about a point extending above the adjacent rail. When the retarding system is located at a comer, cars of the train may come into contact the with retarder system. The inadvertent contact between the car and the retarder system may cause damage to the train, the car retarder itself, or, in some cases, even derailment.

Secondly, a significant volume of fluid under pressure must be supplied to the cylinder of the actuator to activate the brake, and removed from the cylinder to deactivate the brake. A substantial time period is necessary, therefore, to activate and deactivate the frictional braking members. Furthermore, the fluid must be compressed to a relatively high pressure of about 16,500 pounds force to activate the piston cylinder actuator. Because of the high volume and pressure levels required to control the piston cylinder actuator, it is difficult to provide repeatable incrementally-controlled braking action. Generally, piston cylinder actuators provide on and off positions braking positions, and only a very limited range of intermediary "slowing" positions between. Therefore, when using pneumatic or hydraulic piston cylinder actuators, railway cars are not slowed to a controlled stop, but rather are stopped abruptly.

In addition, in piston cylinder actuators, a seal must be positioned between the movable piston and the cylinder. To assure that a vacuum is maintained between the piston and the cylinder, grease-based or graphite packing materials must be packed around the seal. The seals, however, wear with time and temperature, and may release hydraulic or other fluids into the ground around the actuator. Actuators of this type, therefore, pose an environmental problem for the classification yard. Moreover, the packing materials are very temperature sensitive and harden as the ambient temperature falls. Therefore, as the temperature falls, the amount of pressure required to move the cylinder increases, making it increasingly difficult to retard the cars, and increasingly difficult to accurately control the braking action of the frictional braking members.

It is therefore an object of the invention to provide a railway car retarder which does not interfere with railway car operations when placed at a comer of a classification yard.

It is therefore an object of the invention to provide a railway car retarder which can be activated and deactivated quickly.

It is another object of the invention to provide a railway car retarder which is activated by a relatively low volume of fluid at a relatively low pressure.

It is a further object of the invention to provide a railway car retarder which can be incrementally controlled to provide a wide range of braking levels.

It is yet a further object of the invention to provide a railway car retarder which operates consistently over a wide temperature range.

It is a still further object of the invention to provide a railway car retarder which is environmentally safe.

In one aspect, the present invention is a low-profile railway car retarder system, designed to prevent interference between the passing cars and the retarding system itself as the cars pass the retarder, and particularly where retarders are located at curves in the track. The low-profile car retarder system employs upper and lower levers which pivot about a fulcrum point under the rail itself. The levers are each coupled to an associated brake beam support and brake stop. The brake stops are applied to the passing railway car to stop the car. The levers and brake beam supports are all maintained at a level below the height of the adjacent rail. Therefore, all of the components of the retarding system are positioned to prevent inadvertent contact with passing cars. Furthermore, the levers are controlled by a bladder-activated braking actuator. The bladder-activated actuator is activated by a relatively low volume of compressed air or other fluids. Therefore, the bladder-activated braking actuator is smaller and has a lower profile than prior art systems.

In another aspect, the invention is a railway car retarder system with an improved control system. As noted above, the railway car retarder is activated by a braking actuator controlled by a bladder. The bladder is activated by a relatively low volume of compressed air or other fluids. The amount of pressure required to activate the bladder, therefore, is significantly lower than in prior art hydraulic devices. The bladder also operates at higher pressures, thereby providing a larger operating range than conventional methods. Furthermore, the bladder is not sensitive to changes in ambient, and can be repeatably controlled at any temperature. Additionally, the bladder is sealed on all sides, and does not require a lubricant. Therefore, the bladder braking actuator substantially eliminates the environmental problems often associated with the prior art.

Other advantages and features of the invention, together with the organization and manner of operation thereof, will become apparent from the following detailed description when taken in conjunction with the accompanying drawings wherein like elements have like numerals throughout the drawings.

DETAILED DESCRIPTION OF THE PREFERRED EMBODIMENTS

Figure 1:
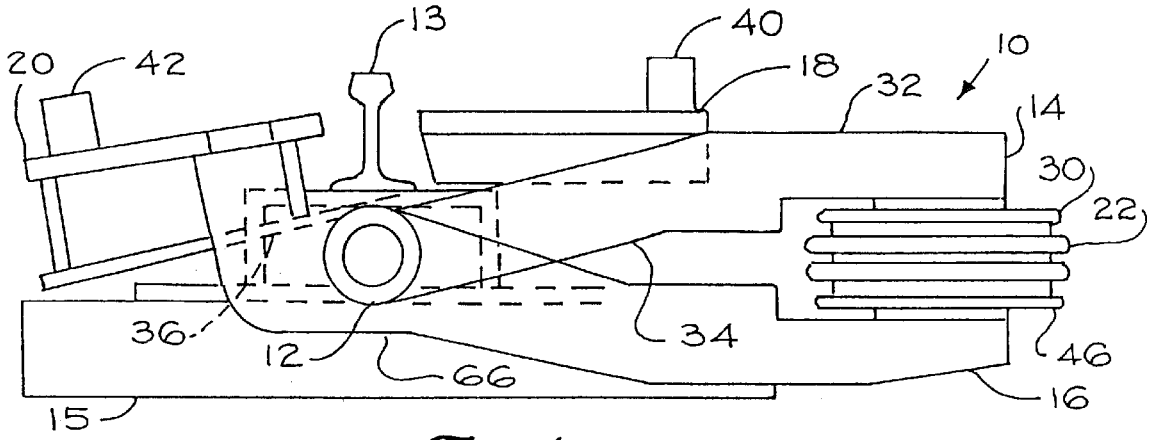
FIG. 1 is a side view of the low-profile car retarder system of the present invention.

Referring to the Figures and more particularly to FIG. 1 a preferred embodiment of the low-profile railway car retarder system of the present invention is shown at 10. The railway car retarder system comprises a fulcrum pin 12, positioned between the rail 13 of a railway track and the wood tie 15. An upper lever 14 and lower lever 16 are pivoted around the fulcrum pin 12. A first brake beam support 18 is positioned at the external side of the rail 13, while a second brake beam support 20 is positioned internally of the track. A bladder activated braking actuator 22, which is inflated to operate the car retarder system 10, is positioned between the upper lever 14 and lower lever 16. The upper lever 14 is positioned at a level below a horizontal plane drawn from the top of the rail, thereby preventing inadvertent contact with passing cars.

Figure 2:
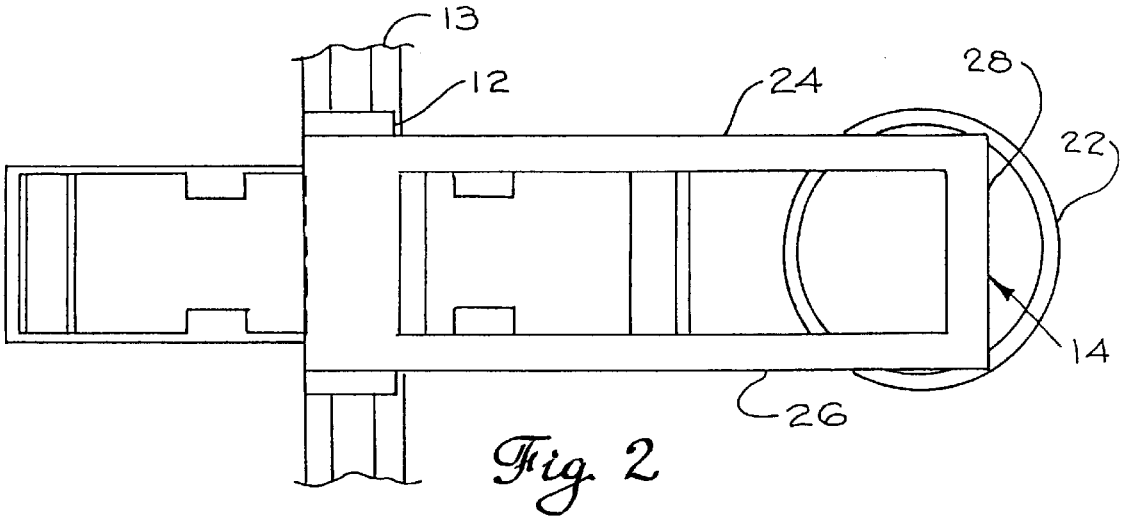
FIG. 2 is a top view of the low-profile car retarder system shown in FIG. 1.

Referring now to FIG. 2, it can be seen that the upper lever 14, comprises two generally parallel arms 24 and 26 extending from the fulcrum pin 12 to a position directly above the bladder activated braking actuator 22. The aims 24 and 26 are coupled together with a support tube 28, which is generally perpendicular to the parallel arms 24 and 26. The support tube 28 is coupled to the arms 24 and 26 in a position horizontally below the top of the rail 13, to prevent inadvertent contact between a passing railway car and the support tube 28. Although a bottom view of the railway retarder system 10 is not shown, it is understood that the construction of the lower lever 16, as will be described more fully below, is essentially a mirror image of the upper lever 14.

Each of the parallel arms 24 and 26 of the upper lever 14 basically comprises two sections: a horizontally extending section 32, positioned above the bladder-controlled braking actuator 22, and an angled section 34, extending from the fulcrum pin to the horizontally extending section 32. The support tube 28 is coupled to the horizontally extending position 32. As can be seen from FIG. 1, the lower lever 16 includes an extension 66 which extends beyond the fulcrum pin 12, beneath the second brake beam support 20. The upper lever 14, however, substantially ends at the fulcrum pin 12.

Referring again to FIG. 2, it can be seen that the first brake beam support 18 is positioned between the arms 24 and 26 of the upper lever 14 on the external side of the track adjacent the bladder actuated braking actuator 22. The second brake beam support 20 is positioned directly opposite the first brake beam support 18, on the internal side of the track.

Referring again to FIG. 1, the second brake beam support 20 includes a base 36 which extends between the fulcrum pin 12 and the rail 13. The base 36 of the first brake beam support 18, however, extends only as far as the rail 13. Both the first brake beam support 18 and second brake beam support 20 are coupled to a stop block, 40 and 42, respectively.

Figure 3:
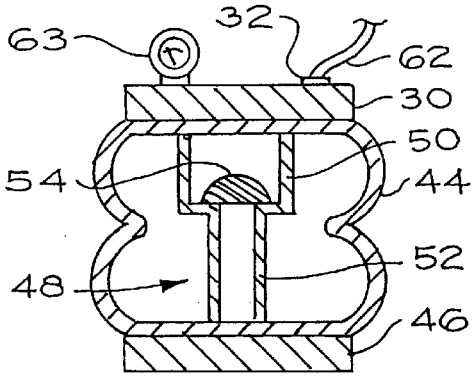
FIG. 3 is an internal view of the bladder activated braking actuator as shown in FIG. 1.

Referring now to FIG. 3, a preferred embodiment of the bladder activated braking actuator 22 is shown. Preferably, the bladder 44 comprises a hollow tubular member of a flexible material capable of expanding and contracting. Preferably, the bladder comprises a pneumatic rubber bellows manufactured by Firestone and sold under the trade name Airstroke®g. The upper and lower cover plates 30 and 46 are coupled to the open ends of the tubular bladder 44, enclosing the bladder and providing an air-right, water impervious seal.

Preferably, the bladder activated braking actuator 22 includes a guiding mechanism 48, which prevents relative lateral motion between the upper cover plate 30 and the lower cover plate 46. In a preferred embodiment, the guiding mechanism 48 comprises a first tubular member 50 coupled to the upper cover plate 30 and a second tubular member 52 coupled to the lower cover plate 46. The first tubular member 50 is disposed in cooperative relation with the second tubular member 52.

The first tubular member 50 is located in a substantially centered position on the upper cover plate 3 0 and extends generally perpendicular to the upper cover plate 30. The second tubular member 52 is located in a substantially centered position on the lower cover plate 46 and extends perpendicular to the lower cover plate 46, in a telescoping relation with the first tubular member 50. The second tubular member 52 includes a stop ring 54, which prevents the upper cover plate 30 and lower cover plate 46 beyond a set point determined by the length of the first and second tubular members 50 and 52. In a preferred embodiment the guiding mechanism 48 further includes a graphite impregnated bushing interposed between mating surfaces of the tubular members 50 and 52. In addition to providing the function of preventing relative lateral motion between the cover plates 30 and 46, the size of the guiding mechanism 48 can be used to modify the amount of fluid necessary to expand the bladder 44.

Figure 4:
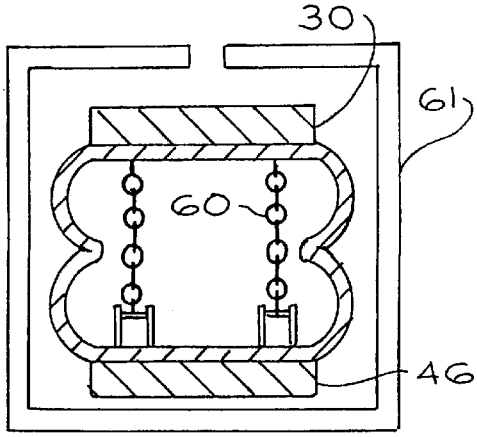
FIG. 4 is an internal view of an alternate embodiment of the bladder activated braking actuator as shown in FIG. 1.

Referring now to FIG. 4, the bladder activated braking actuator 22 may further include at least one retention mechanism 60 for limiting relative motion between the cover plates 30 and 46. The retention mechanism 60 preferably comprises at least one flexible member coupled between the upper and lower cover plates 30 and 46. The retention mechanism 60 may comprise a chain, a rubber member, or any number of known devices. In some cases, however, the bladder activated braking actuator 22 may include external guiding and retention mechanisms 61. Preferably, the external guiding mechanism comprises a pair of generally U shaped arms forming a frame around the braking actuator. Although both internal and external mechanisms are shown, it will be apparent that either an internal retention mechanism, an external retention mechanism, or both could be used.

Referring again to FIG. 3, the upper cover plate 30 preferably includes an aperture 32 for receiving a hose fitting or other known device for attaching a hose 62 or other tubular member to the bladder 44. The hose 62 carries fluid from a compressor or other fluid source (not shown) into the bladder. A fluid flow control (also not shown), preferably including a flow gauge 63, is coupled between the hose and first plate to control the flow of fluid into and out of the bladder. Preferably, the fluid is compressed air. However, one skilled in the art will recognize that any of a number of fluids could be used.

To operate the railway car retarding system 10 shown in FIG. 1, a computerized controller (not shown) preferably signals the fluid flow controller to allow fluid to flow into the braking actuator 22, expanding the bladder 44. The position of the upper lever 14 and the first brake beam support 18 are held constant as the bladder activated braking actuator 22 expands. The expansion of the bladder 44 forces the lower cover plate 46 downward. As the lower cover plate 46 is forced downward, the lower lever 16 rotates about the fulcrum pin 12, causing the extended portion 66 of the lower lever 16 to contact the base 36 of the second brake beam support 20, forcing the braking beam support 20 upward toward the rail 13. The total volume and the pressure of the fluid allowed into the bladder 44 is varied based on any number of parameters. These parameters may include the type of car, the weight of the car, and the contents of the car. For example, cars which contain fragile cargo may be slowed, rather than stopped abruptly. In an alternative embodiment, as the bladder expands, the upper cover plate 30 and lower cover plate 46 are forced apart, thereby causing the levers 14 and 16 to move relative to each other. The levers 14 and 16, in turn, cause the stop blocks 40 and 42 to move into the closed braking position, in which the stop blocks 40 and 42 grip the wheel or wheels of the car to retard the motion.

When the car is retarded to the desired level, the controller signals the fluid flow control to slow or stop the flow of fluid to the braking actuator bladder 44. The fluid flow control may activate a release valve or other device to drain the bladder, therefore causing the bladder to contract, forcing the lower cover plate 46 up, thereby forcing the lower lever up and releasing the second brake beam support 20. Upon release of the second brake beam support 20, the car is allowed to move freely along the track. In an alternative embodiment, the upper cover plate 30 and lower cover plate 46 are forced together, and causing the levers 14 and 16 to move relatively towards each other. As the levers 14 and 16 move, the brake beam supports 18 and 20 are forced to the open braking position, and the car is allowed to move freely along the track.

Figure 5:
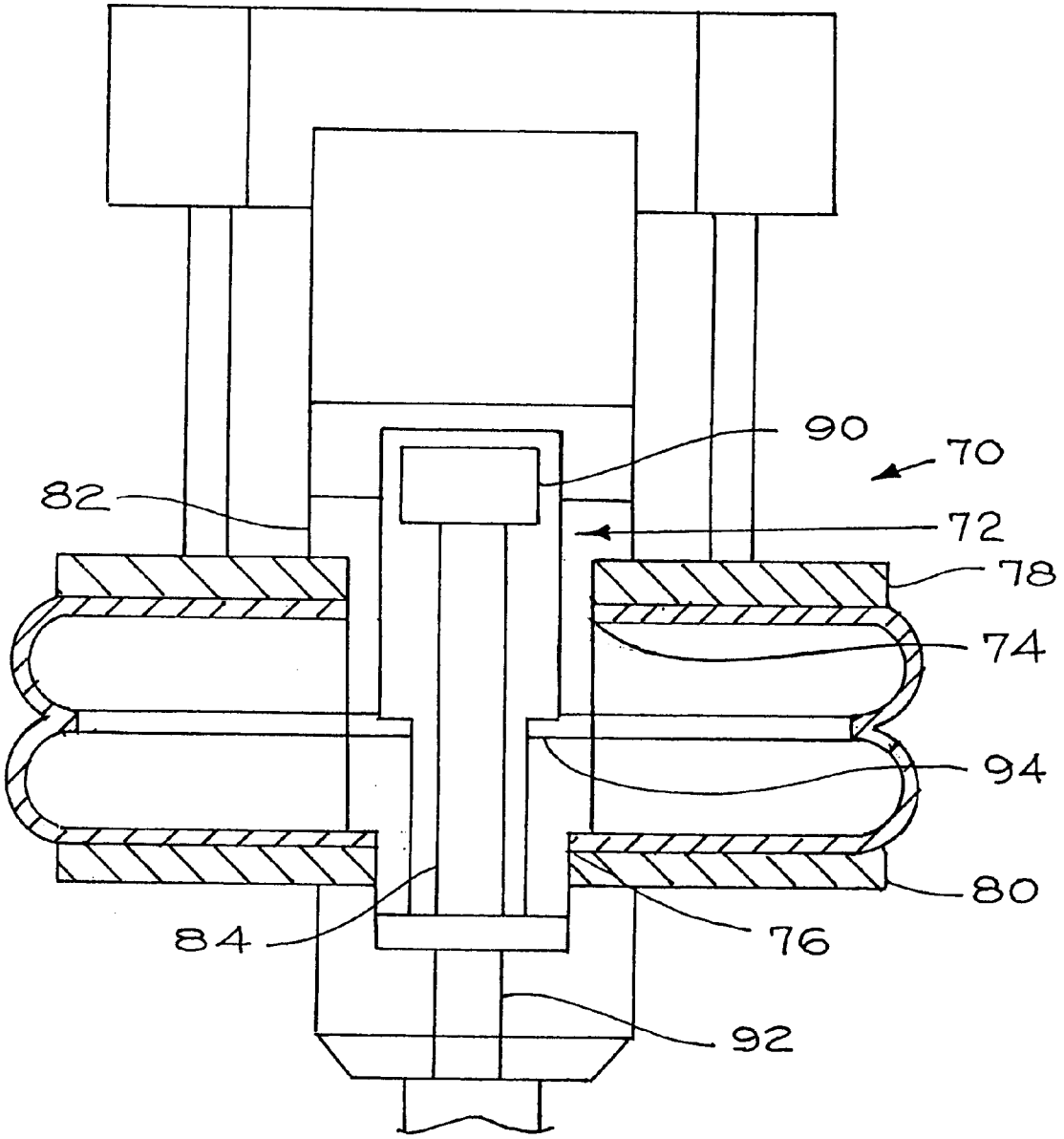
FIG. 5 is an internal view of a bladder activated braking actuator for use with traditional rail systems.

Referring to FIG. 5, a bladder activated braking actuator for use with a traditional retarder system as opposed to the low profile car retarder system 10 described above, is shown at 70. The bladder activated braking actuator 70 includes a guiding mechanism 72 which extends through concentric apertures 74 and 76 in the upper and lower cover plates 78 and 80, respectively. The guiding mechanism 72 generally comprises a guide bushing sleeve 82 and guide rod 84.

The guide bushing sleeve 82 is positioned between the concentric apertures 74 and 76 and provides a channel for the guide rod 84 to move in an up/down direction. The guide bushing sleeve 82 is substantially centered and extends generally perpendicularly between the upper and lower cover plates 78 and 80. The body of the bushing sleeve 82 is substantially tubular. Internally, however, the walls of the bushing sleeve 82 are of two or more thicknesses to provide a stop point for motion of the guide rod 84 in the bushing sleeve. The stop point is provided by an internal ledge 94 established by the thicker portion of the bushing sleeve 82. A flange for coupling the bushing sleeve to the upper cover plate 78 extends circumferentially from the upper portion of the bushing sleeve 84.

The guide rod 84 is located in a substantially centered position in the guide bushing sleeve 82 in a telescoping relation to the guide bushing sleeve 82. The guide rod 84 includes threading on both an upper and lower section. A stop ring 90, dimensioned to allow motion of the guide rod 84 through the thinner portions of the bushing sleeve 82, while preventing motion through the thicker portions, is coupled to the threads at the upper end of the guide rod 84. A cylinder rod 92 is coupled to the lower end of the guide rod 84. As the bellows are expanded, and the upper and lower cover plates 78 and 80 move relative to one another, total motion is limited by the interaction of the stop ring 92 and the internal ledge 94.

While preferred embodiments have been illustrated and described, it should be understood that changes and modifications can be made thereto without departing from the invention in its broadest aspects. Various features of the invention are defined in the following claims.

We claim:

1. A low-profile railway car retarder system for controlling the speed of rail cars moving along rails of a railway track, the system comprising:

a fulcrum pin positioned between a rail and a wood tie of the railway track;

an upper lever and a lower lever, wherein at least one of the upper lever and the lower lever is disposed to pivot about the fulcrum pin;

first and second brake beam supports coupled to the upper and lower levers, respectively, such that the brake beam supports are positioned adjacent and on opposite sides of the rail;

first and second stop blocks coupled to the first and second brake beam supports, respectively, the first and second stop blocks applying a braking force to a passing train when at least one of the first and second levers is pivoted about the fulcrum pin;

a braking actuator including a first cover plate, a second cover plate, and a bladder disposed between the first and second cover plates, wherein the first plate is coupled to the upper lever, and the second plate is coupled to the lower lever;

at least one valve coupling the braking actuator to a fluid source for supplying fluid to expand the bladder, thereby causing at least one of the first and second stop blocks to rotate toward the rail and apply a frictional force to a passing rail car; and a retention mechanism including a pair of generally U-shaped arms external to the braking actuator and forming a frame around the braking actuator;

wherein the braking actuator, the upper and lower levers, and the first and second brake beam supports are located beneath a horizontal plane drawn in a direction substantially perpendicular to the top of the rail to prevent inadvertent contact between the railway car retarder system and passing rail cars.

2. The railway car retarder system as defined in claim 1, wherein the upper lever is stationary and the lower lever pivots about the fulcrum pin.

3. The railway car retarder system as defined in claim 1, wherein each of the upper and lower levers comprises a first arm disposed in a substantially parallel relationship to a second arm, the first and second arms being coupled together with a support tube.

4. The railway car retarder system as defined in claim 1, wherein the first brake support beam is positioned externally of the rail and the second brake support beam is positioned internally of the track.

5. The railway car retarder system as defined in claim 1, further comprising a controller coupled to the at least one valve for controlling the volume of fluid in the bladder, thereby controlling a braking force produced by the first and second stop blocks.

6. A braking actuator for a railway car retarder system, the braking actuator comprising:

a first plate;

a second plate;

a bladder located between the first and second plates;

a fluid flow control for regulating a supply of compressed fluid to the bladder; and a guiding mechanism for limiting relative lateral motion of the first and second plates, the guiding mechanism including a guide rod positioned concentrically in a guide bushing sleeve, the bushing sleeve establishing upper and lower limits of motion of the guide rod as the bladder is expanded.

7. The railway car retarder system as defined in claim 6, wherein the guide bushing sleeve is located in a substantially centered position and extends generally perpendicularly between the upper and lower cover plates, and the guide rod is located in a substantially centered position in the guide bushing sleeve in telescoping relation with the guide bushing sleeve.

8. The railway car retarder system as defined in claim 6, wherein the guide rod and guide bushing sleeve are located within the bladder.

9. A braking actuator for a railway car retarder system, the braking actuator comprising:

a first plate;

a second plate;

a bladder located between the first and second plates;

at least one retention mechanism for limiting relative motion between the first and second plates, the retention mechanism including a pair of generally U-shaped arms external to the braking actuator and forming a frame around the braking actuator; and a fluid flow control for regulating a supply of compressed fluid to the bladder.

10. The braking actuator as defined in claim 9, and further including a flow gauge for monitoring the pressure of the fluid in the bladder.

11. The braking actuator as defined in claim 9, wherein the first plate includes a fluid inlet adapted for coupling to a source of fluid under pressure for controlling expansion and contraction of the bladder.

* * * * *